United States Patent [19]

Uchida

[11] Patent Number: 4,834,304

[45] Date of Patent: May 30, 1989

[54] YARN END FINDING DEVICE

[75] Inventor: Hiroshi Uchida, Oumihachiman, Japan

[73] Assignee: Murata Kikai Kabushiki Kaisha, Kyoto, Japan

[21] Appl. No.: 38,357

[22] Filed: Apr. 14, 1987

[30] Foreign Application Priority Data

Apr. 16, 1986 [JP] Japan ..... 61-87547

[51] Int. Cl.[4] ..... B65H 67/08

[52] U.S. Cl. ..... 242/35.6 E; 242/18 R; 30/133; 83/100; 83/411 R; 83/427; 83/909

[58] Field of Search ..... 242/35.6 E, 35.6 R, 242/35.5 R, 18 R, 19; 30/133, 124; 83/100, 402, 411 R, 427, 909

[56] References Cited

U.S. PATENT DOCUMENTS

| | | | |
|---|---|---|---|
| 1,750,535 | 3/1930 | McCollum | 83/427 X |
| 2,115,102 | 4/1938 | Gottfried et al. | 83/427 |
| 4,108,388 | 8/1978 | Schar | 242/19 X |
| 4,660,780 | 4/1987 | Otoshima | 242/35.6 E |

*Primary Examiner*—Stanley N. Gilreath

*Attorney, Agent, or Firm*—Spensley Horn Jubas & Lubitz

[57] ABSTRACT

A yarn end finding device includes a rotary cutter in the form of a drum which has a yarn end sucking holes formed in an outer peripheral surface thereof, and a movable blade having thereon a cutting edge adapted to press against and contact with the outer peripheral surface of the rotary cutter, wherein the movable blade is reciprocally moved in a direction substantially perpendicular to the direction of rotation of the rotary cutter.

17 Claims, 6 Drawing Sheets

FIG. 7
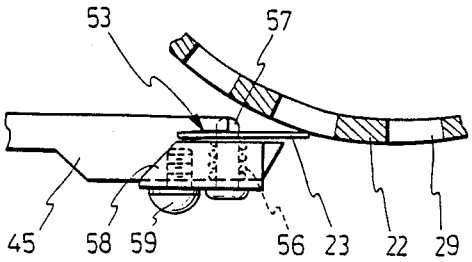
FIG. 8
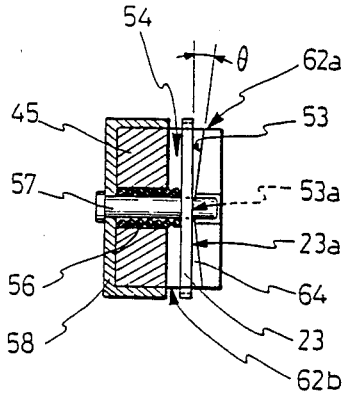
FIG. 9
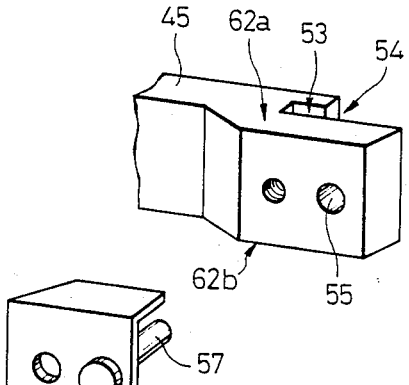
FIG. 10
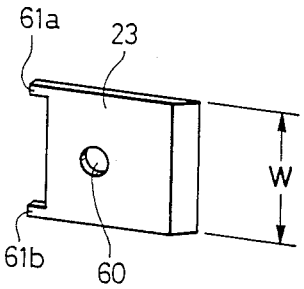
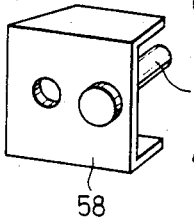
FIG. 11

YARN END FINDING DEVICE

BACKGROUND OF THE INVENTION

1. Field of the Invention

This invention relates to a yarn finding device for a winder.

A bobbin produced on a spinning frame, particularly on a ring spinning frame, normally has, adjacent end turns of a yarn thereon, a so-called tail yarn wound in several turns on a tail or head portion thereof in order to prevent an end of the yarn from being released from the bobbin or from clinging to an end of a yarn on another bobbin when the bobbin is transported to a subsequent rewinding step.

When a spinning bobbin having such a tail yarn thereon is to be supplied to a subsequent next rewinding step, that is, to an automatic winder, it is once supplied to a yarn end readying apparatus on which the tail yarn is released from the spinning bobbin in preparation for subsequent automatic splicing of the yarn to another yarn, and is then supplied to a winding unit.

In a yarn end finding device of such a yarn end readying apparatus, when a tail yarn wound on a tail or head portion of a bobbin is to be released or removed, beginning and last ends of a yarn which was wound on the bobbin by a spinning frame may sometimes be turned with and cling to each other to such a degree that it is difficult to release the tail yarn from the bobbin. Or else, where a reinforcing annular metal member is fitted on one or each of opposite ends of a take-up tube of the bobbin, the tail yarn may enter a gap which may possibly appear between the metal member and the take-up tube so that it may be impossible to release the tail yarn from the bobbin unless compressed air is blown to the bobbin or the bobbin is placed within a suction air flow. In either case, finding of a yarn, end will fail.

2. Description of the Related Art

As a device which can prevent such failure in finding an end of a yarn, the present applicant already proposed a device which is disclosed in Japanese patent laid-open No. 60-213669. In the proposed device, a suction cutter in the form of a drum which rotates along a cylindrical inner peripheral face of a suction case has a large number of yarn sucking holes formed in an outer peripheral face thereof, whereby an end of a yarn which is sucked in through a yarn passing hole of the suction case and one of the holes of the suction cutter is compulsorily fed along a very small gap defined between the outer peripheral face of the suction cutter and the inner peripheral face of the suction case and is thus abutted with the outer peripheral face of the suction cutter so that it is cut off by a fixed blade securely mounted on the suction case.

In the proposed device described above, there is a problem that, if an end of a yarn in a lump having a thickness corresponding to that of several very heavy yarns is sucked and comes to a position of the fixed blade, they may not be cut or may pass by the fixed blade and be wrapped around a rotary shaft or otherwise cause the outer peripheral face of the suction cutter and a cutting edge of the fixed blade to be contacted with each other under pressure, which may result in damage to the cutting edge of the fixed blade so that the sharpness in cutting of the fixed blade may become blunt in a short period of time. Accordingly, the proposed device is not practical.

SUMMARY OF THE INVENTION

It is an object of the present invention to provide an improved rotary cutter for a yarn end finding device, wherein a good sharpness in cutting is always be assured.

According to an embodiment of the present invention, there is provided a yarn end finding device which includes a rotary cutter in the form of a drum which has a yarn end sucking holes formed in an outer peripheral surface thereof, and a movable blade having thereon a cutting edge adapted to press against and contact with the outer peripheral surface of the rotary cutter, wherein the movable blade is reciprocally moved in a direction substantially perpendicular to the direction of rotation of the rotary cutter.

As the movable blade is reciprocally moved in the direction substantially perpendicular to the direction of rotation of the rotary cutter on the outer peripheral face of the rotary cutter, it will cut off a yarn fed thereto while sliding its cutting edge perpendicularly to the yarn.

BRIEF DESCRIPTION OF THE DRAWINGS

FIG. 7 a plan view showing a mechanism for mounting the blade on a lever;

FIG. 8 a cross sectional side elevational view of the mechanism of FIG. 7;

FIG. 9 a perspective view illustrating a shape of an end portion of the lever;

FIG. 10 a perspective view showing a blade;

FIG. 11 a perspective view showing a cover; and

DETAILED DESCRIPTION OF PREFERRED EMBODIMENTS

Now, an embodiment of the present invention will be described with reference to the drawings.

Figure 12:
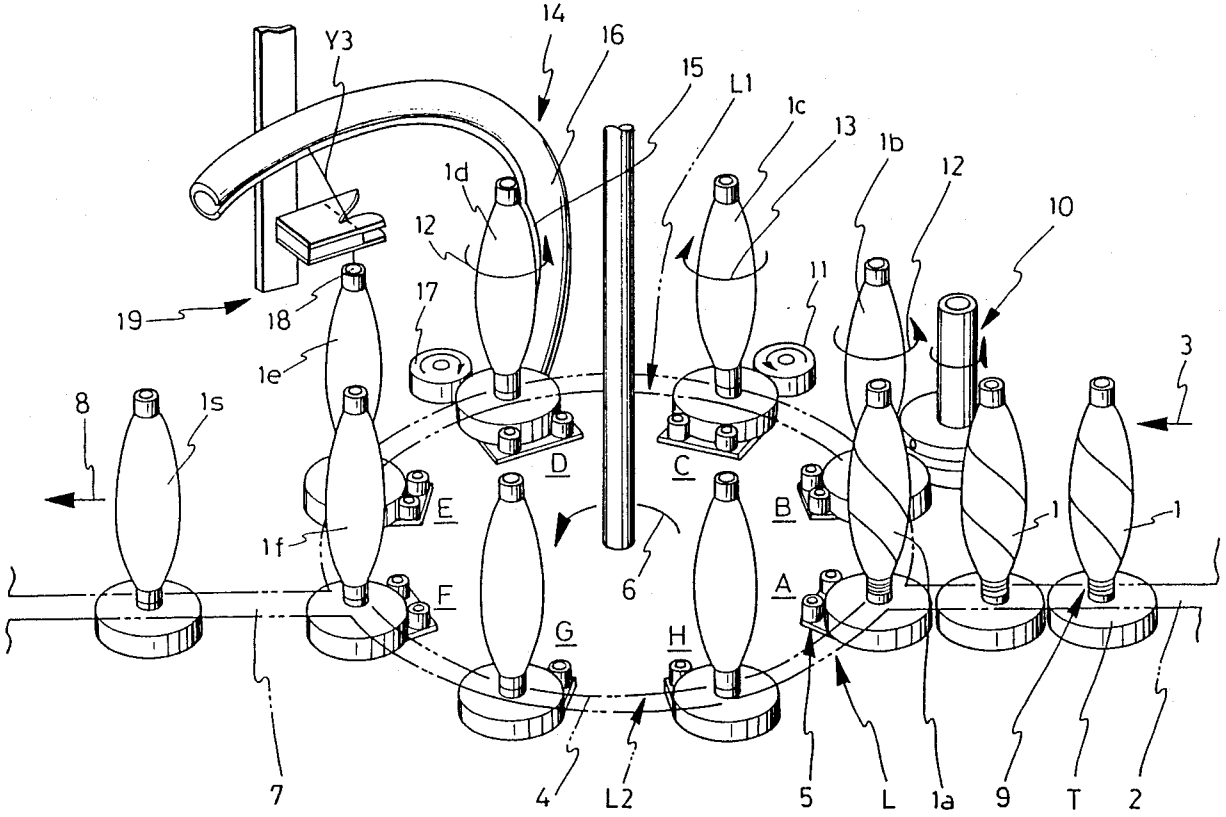
FIG. 12 a perspective view showing general construction of an example of yarn readying apparatus to which a device of the present invention is applied.

FIG. 12 illustrates an example of yarn end readying device to which a yarn end finding device of the present invention is applied.

A bobbin 1 produced on a spinning frame is fitted on a tray T and fed in a direction of an arrow mark 3 on a transport path 2 to an admitting position A of a yarn end finding device. There, the bobbin 1 is received at one of tray receiving portions 5 formed in a spaced relationship by a fixed distance on a rotary plate 4 of the readying device, and as the rotary plate 4 is intermittently rotated in a direction of an arrow mark 6, the bobbin 1 successively passes processing stations B, C, D and E and finally reaches a delivery station F at which, where an end of a yarn has been successfully picked up from the bobbin 1, the bobbin here denoted at lf in FIG. 12 is transported in a direction of an arrow mark 8 on another transport path 7 toward a winder.

Located at the station B is a yarn end finding device 10 for releasing and cutting bunch wound on a lower portion of a bobbin 1*b* while a rotating roller 11 for drawing out a portion of a yarn extending between a bobbin 1*c* and the yarn end finding device 10 and for winding the yarn portion lightly on a layer of the yarn on the bobbin 1*c* is located at the station C. At the station B, the bobbin 1*b* is rotated in a direction 12 to release a yarn wound thereon by a friction roller, and at the station C, the bobbin 1*c* is rotated in a direction 13 to wind the yarn thereon by the roller 11. Further, a suction mouth 14 for sucking and releasing an end of a yarn in a free condition on a bobbin 1*d* is located at the station D. At the station D, the bobbin 1*d* is rotated in the direction 12 to release a yarn therefrom by a roller 17. Meanwhile, located at the station E is a yarn end inserting mechanism 19 for cutting an end of a yarn drawn out from a bobbin 1*e* into a string of a fixed length and for inserting a new end of the yarn thus cut into a center hole 18 of the bobbin 1*e*.

It is to be noted that a tray T serving as a transport medium for a bobbin has a peg formed on a disk member thereof and has an air passing hole formed therein through which air may pass in order to put an end of a yarn into the take-up tube of a bobbin and to subsequently put an end of a yarn out of the take-up tube of a bobbin at the winder.

Now, an embodiment of the yarn end finding device 10 installed at the station B will be described with reference to FIGS. 1 and 2.

The yarn end finding device 10 includes a suction case 21 securely mounted on a frame 20, a rotary cutter 22 mounted for rotation within the suction case 21, a movable blade 23 contacted under pressure with and sliding on an outer peripheral face of the rotary cutter 22, and a driving device 24 for driving the rotary cutter 22 and the movable blade 23.

The suction case 21 is secured in position between the frame 20 and another frame 25 by means of pins 26 and is in the form of a thin tubular member having an inner peripheral face of a substantially same diameter with an outer peripheral face of the rotary cutter 22 and covering the entire periphery of the rotary cutter 22 except a clearance partly formed therein to allow the movable blade 23 to project therethrough and contact with the rotary cutter 22. The suction case 21 is partially constituted from a rockable member 28 which is mounted for rocking motion around a shaft 26*a* and has a yarn sucking port 27 formed therein for communication with one of yarn end sucking holes of the rotary cutter 22 which will be hereinafter described.

Figure 2:
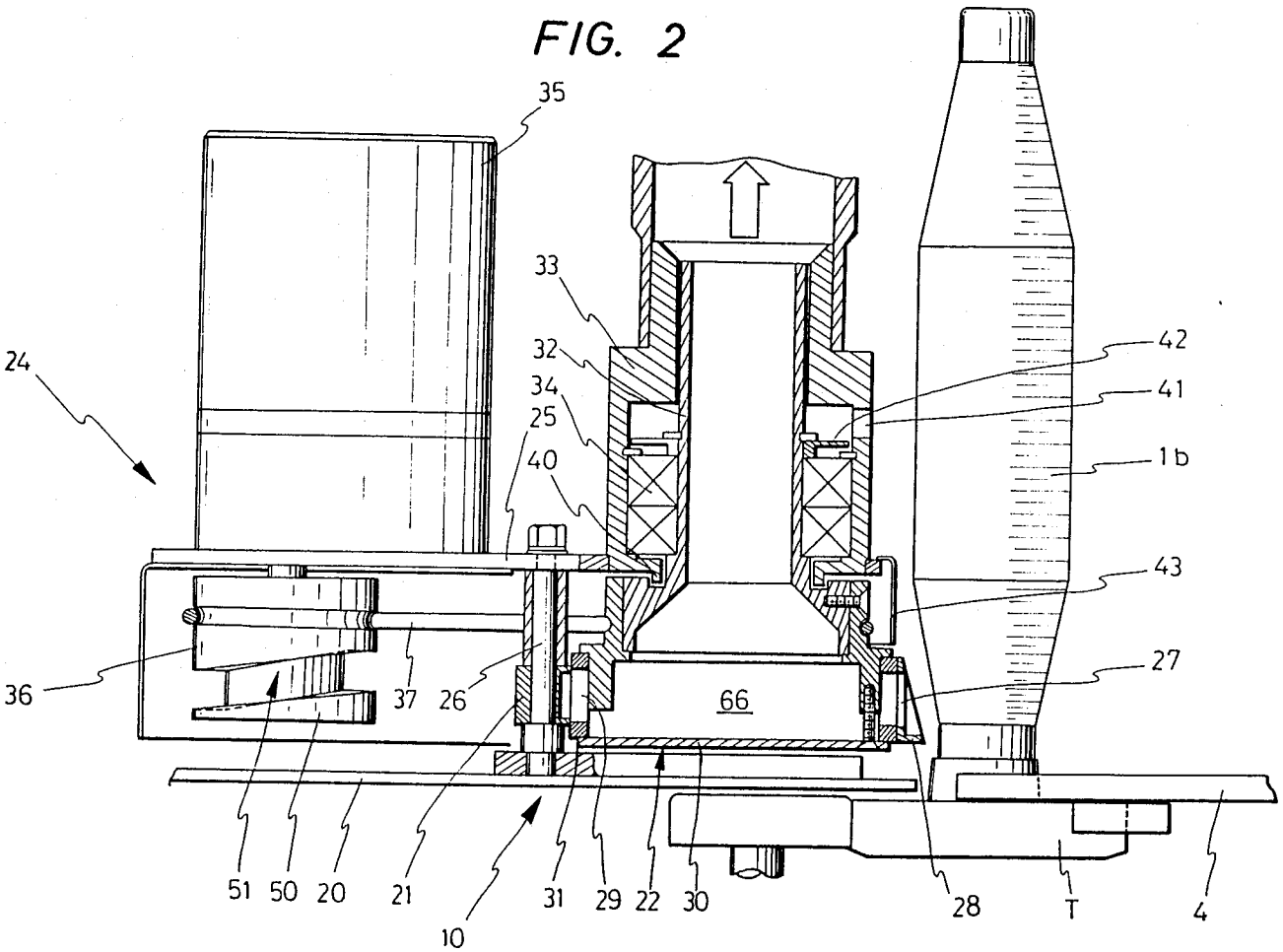
FIG. 2 a front elevational cross sectional view of the device of FIG. 1.
Figure 3:
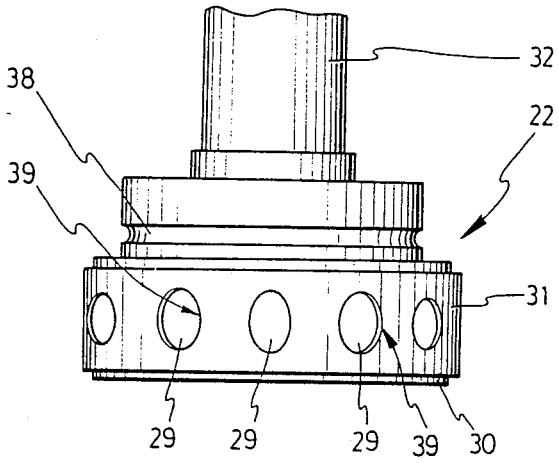
FIG. 3 a front elevational view of a rotary cutter.

Meanwhile, the rotary cutter 22 which rotates along the inner peripheral face of the suction case 21 is in the form of a rotary member 31 which has a plurality of yarn end sucking holes 29 formed in an outer peripheral face thereof and to which a bottom plate 30 is secured as shown in FIGS. 2 and 3. The rotary member 31 has a tubular portion 32 formed thereon and projected upwardly therefrom, and is supported at the tubular portion 32 thereof for rotation on a fixed housing 33 by means of a bearing 34. The top end of the tubular portion 32 of the rotary member 31 is opened and communicates with a suction source not shown. The rotary member 31 has formed at a portion thereof a groove 38 for receiving a round belt 37 to be extended between the rotary member 31 and a drive pulley 36 on a motor 35. Accordingly, the rotary member 31 is rotated by the round belt 37, but if an overload is applied to the rotary member 31, rotation of the pulley 36 on the motor 35 will not be transmitted to the rotary member 31, which will assure safety of the device. For example, in case a yarn is stuffed in a lump between the movable blade and the rotary cutter as will be hereinafter described, rotation of the rotary member may be held from rotation thereby while only movement of the movable blade is allowed.

The yarn end sucking holes 29 formed in the rotary cutter 22 have a circular cross section as seen from FIG. 3, and cutting edges 39 are defined by circular peripheries of the yarn end sucking holes 29 and the outer peripheral face of the rotary member 31.

It is to be noted that, in FIG. 2, reference numeral 40 denotes an annular projected piece for preventing fly waste from coming to the bearing 34. Entering and adhesion of fly waste to the bearing 34 is further prevented by an air outlet hole 41 formed in the housing 33 and also by covers 42, 43 which hinder a flow of air to the bearing 34.

Figure 1:
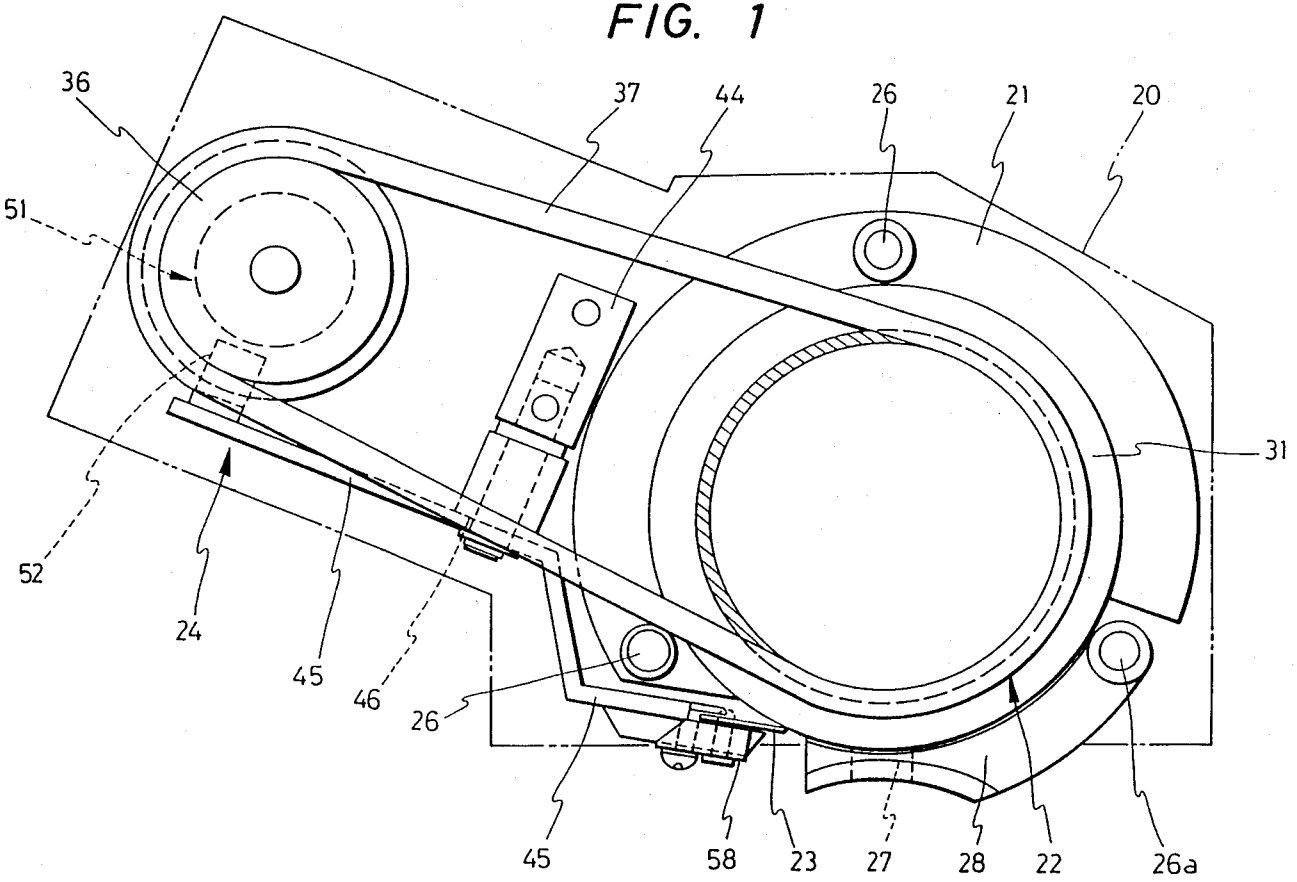
FIG. 1 is a plan view showing an embodiment of a device of the present invention.
Figure 5:
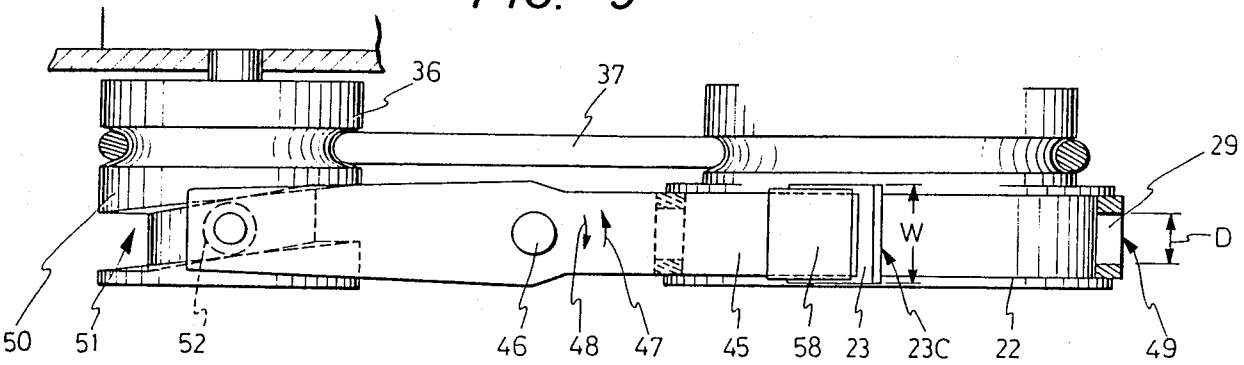
FIG. 5 a front elevational view showing a driving mechanism for a blade.

Referring now to FIGS. 1, 2 and 5, the movable blade 23 for contacting with the outer peripheral face of the rotary cutter 22 will be described. In particular, a lever 45 is supported for rocking movement on a bearing 44 on the frame 20 and is mounted for rocking motion in directions indicated by arrow marks 47, 48 in FIG. 5 around a shaft 46. The blade 23 is mounted at an end of the rockable lever 45 by a mechanism which will be described hereinbelow such that it may move tracing an outer peripheral face 49 of the rotary cutter 22. Meanwhile, a cam follower 52 for engagement with a cam groove 51 formed in a cam drum 50 which is connected to be rotated by the motor 35 is mounted at the other end of the lever 45. It is to be noted that while in the embodiment shown the cam drum 50 is formed in an integral relationship with the pulley 36 for driving the rotary cutter 22, naturally they may otherwise be formed in separate bodies which are driven independently of each other such that the speed of movement of the movable blade 23 may be adjusted with respect to the speed of rotation of the rotary cutter 22.

Mounting of the blade 23 on the lever 45 will be described now with reference to FIGS. 7 to 11. An end of the lever 45 has a substantially channel-shape profile in plan while a receiving face 53 of the blade 23 is formed as a pair of vertically inclined faces with central portions thereof projected in a direction toward the blade 23 as seen in FIG. 8 so that as the blade 23 is pressed against the outer peripheral face of the rotary cutter 22, in whichever direction the blade 23 is moved, the entire cutting edge of the blade 23 may be pressed against the outer peripheral face of the rotary cutter 22 as in an automatic tracing action.

Figure 6:
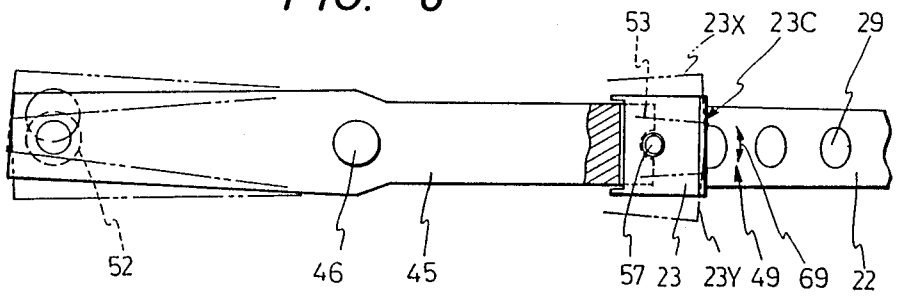
FIG. 6 a front elevational view illustrating movement of the blade.

The blade 23 is inserted into a channel-shaped recess 54, and then a compression spring 56 is inserted into a hole 55 which is formed to extend through the lever 45, whereafter a cover plate 58 on which a pin 57 is securely mounted is fitted onto and secured to the lever 45 by means of a screw 59 as shown in FIG. 7, thereby completing assembly of the blade 23. It is to be noted that the pin 57 extends further through a hole 60 in the blade 23 to support the blade 23 in position thereon. It is also to be noted that a pair of projections 61*a*, 61*b* formed at upper and lower portions of the blade 23 engage, when the blade 23 is fitted in the recess 54 of the lever 45, with upper and lower faces 62*a*, 62*b*, respectively, of the lever 45 with small gaps left therebetween, thereby to prevent turning motion of the blade 23 around the pin 57 and contribute to stabilization in posture of the blade 23. In particular, due to an inclined gap 64 of an angle $\theta$ between a pressing face 23*a* of the blade 23 and the receiving face 53 of the lever 45, as the lever 45 is displaced around the shaft 46 of FIG. 6, the blade 23 is controlled in posture around an apex 53*a* of the receiving face 53 while tracing the peripheral face 49 of the rotary cutter 22. Accordingly, the cutting edge of the blade 23 will press against the outer peripheral face of the rotary cutter 22 uniformly over the entire range thereof. It is to be noted that the width W of the blade 23 is greater than the diameter D of the holes 29 of the rotary cutter 22 shown in FIG. 5 and, within a range 23X, 23Y of the rocking motion of the lever 45 as shown in FIG. 6, the cutting edge 23C of the blade 23 does not miss the holes 29 of the rotary cutter 22 at all, or in other words, the holes 29 are normally contained within a range of the cutting edge 23C of the blade 23.

Figure 4:
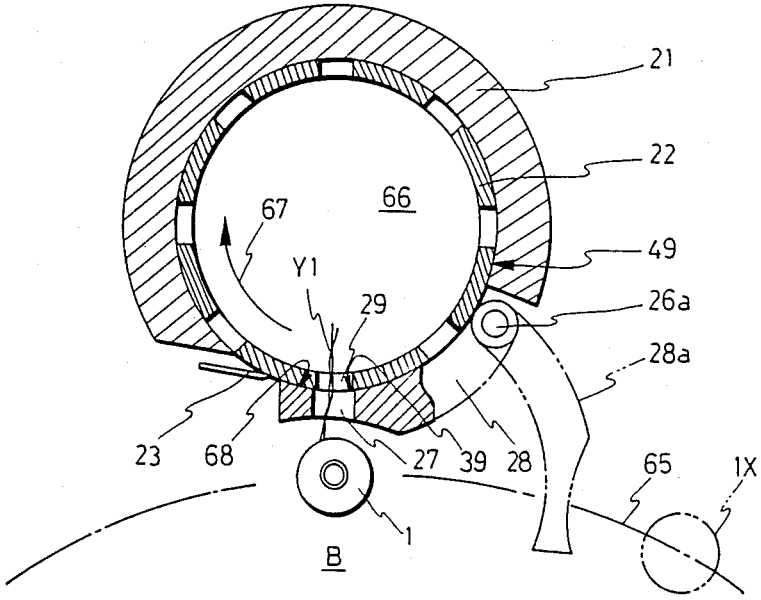
FIG. 4 a cross sectional plan view illustrating a yarn cutting action.

Accordingly, in FIG. 4, if a bobbin 1 which is fed in a direction of an arrow mark on a path 65 arrives at the station B and thus positioned there, a sucking force acts upon a bunch winding portion of the bobbin 1 via the holes 29 of the rotary cutter 22 and the suction port 27 of the suction case 21 due to a negative pressure appearing in an inner spacing 66 of the rotary cutter 22 so that an end Yl of a yarn is sucked in, passing the holes 27 and 29. Since the rotary cutter 22 is rotating in a direction of an arrow mark 67, the yarn end thus sucked in is fed compulsorily in a direction of rotation of the rotary cutter 22 by one of the holes 29 of the rotary cutter 22. Consequently, the yarn at the bunch winding portion is compulsorily released from the bobbin 1. Thus, as the yarn comes to the blade 23, it is cut by the cutting edge 39 formed around the hole 29 and the movable blade 23 as described hereinabove. It is to be noted that since in this instance the yarn end Yl shown in FIG. 4 is fed while it is held nipped between the outer peripheral face 49 of the rotary cutter 22 and an inner peripheral face 68 of the suction case 21, it can be released by a very strong force comparing with an instance wherein it is released by a mere sucking force. Accordingly, even a yarn clinging to a bobbin or a yarn caught by a metal member of a bobbin can be released and drawn out from the bobbin.

Further, even in case a yarn drawn out from a bobbin comes to a position of the blade 23 while it is held in a clinging condition or in case a yarn in a lump having a thickness corresponding to that of several strings of a very heavy yarn is fed to a position of the blade 23, a cutting action of the blade 23 is very good because the blade 23 is sliding in a direction 69 substantially perpendicular to the direction 67 of movement of the outer peripheral face of the rotary cutter 22. This is because a similar principle applies that, when a material is to be cut by a kitchen knife, it can be cut more smoothly if the kitchen knife is moved back and forth in its longitudinal direction while it is moved toward a chopping board than if the kitchen knife is moved only in a vertical direction toward the chopping board.

Meanwhile, in case a drawn out lump of a yarn is so thick that it is stuffed between the blade 23 and the outer peripheral face 49 of the rotary cutter 22, an overload may be applied to the rotary cutter 22 and stop the latter because the rotary cutter 22 is connected to the motor 35 via the round belt 37, that is, because a slip will appear between the round belt 37 of FIG. 1 and the rotary member 31. Consequently, only the cam drum 36 on the motor 35 side continues to be rotated to slidably move the blade 23. Accordingly, the lump of the yarn stuffed around the blade 23 is gradually cut off thereby to reduce the stuffing degree, and finally the rotary cutter 22 will start its rotation again to resume ordinary yarn cutting operation.

In case the stopped condition of the rotary cutter 22 continues further, the opening and closing part 28 of the suction case 21 may be opened to a chain line position 28*a* as shown in FIG. 4, and the lump of the yarn stuffed around the blade 23 may be removed therefrom.

It is to be noted that the opening and closing part 28 of the suction case 21 is only loosely fitted on the shaft 26*a* so that if it is left in the open position 28*a*, , it will be pressed by a bobbin 1X subsequently fed thereto and consequently brought thereby automatically to its closed position so that it will be brought by a sucking force within the rotary cutter 22 to the position in which it is contacted with the outer peripheral face of the rotary cutter 22.

As apparent from the foregoing description, according to the present invention, when a yarn sucked in from one of yarn end sucking ports formed in an outer peripheral face of a rotary member is to be cut by a blade which is pressed against the outer peripheral face of the rotary member, the blade is moved reciprocally in a direction substantially perpendicular to the direction of rotation of the rotary member. Accordingly, a yarn cutting action of the blade is very good so that a yarn ranging from a thin yarn to a very heavy yarn as well as a lump of a yarn in the form of a dumpling can be cut by the blade.

Further, since the blade 23 is always making a reciprocating motion while it is pressed against the outer peripheral surface of the rotary member, if it is made of a material having a greater hardness than the hardness of the surface of the rotary member, it will normally act as if it polishes the surface of the rotary member. Accordingly, the peripheral face 49 of the rotary member of FIG. 5 is not partially abraded but is polished uniformly over the entire range thereof so that a good sharpness in cutting can always be assured.

What is claimed is:

1. A device for finding an end of a yarn, comprising:

a rotary cutter having an outer peripheral surface with a yarn end sucking hole formed therein, said rotary cutter being rotatable in a first direction;

a movable blade having a cutting edge adapted to press against and contact said outer peripheral surface of said rotary cutter, said movable blade being reciprocally movable in a direction substantially perpendicular to said first direction of rotation of said rotary cutter;

driving means for rotatably driving said rotary cutter and for reciprocally moving said movable blade, said driving means having a rotatable pulley operatively connected with said rotary cutter;

moving means, operatively connected with and driven by said rotatable pulley of said driving means, for reciprocally moving said movable blade.

2. A device for finding an end of a yarn from a spinning bobbin, said device comprising:

a suction case having an inner peripheral face;

a rotary cutter operable for rotation within said suction case, said rotary cutter having an outer peripheral face; and a driving device operable for driving the rotary cutter and for reciprocally moving said movable blade relative to said rotary cutter, said driving device having a drive pulley;

a belt extending between said rotary cutter and said drive pulley;

a rockable lever, operatively connected with and driven by said drive pulley; and a movable blade supported by said rockable lever and operable to contact and slide on said outer peripheral face of said rotary cutter.

3. A device for finding an end of a yarn as claimed in claim 2, wherein:

said inner peripheral face of said suction case is substantially the same diameter as said outer peripheral face of said rotary cutter;

said inner peripheral face of said suction case substantially covers said outer peripheral face of said rotary cutter; and said inner peripheral face of said suction case has a clearance formed therein for said movable blade to project therethrough.

4. A device for finding an end of a yarn as claimed in claim 3, wherein said suction case comprises a pivotable member which is pivotable relative to said rotary cutter, whereby lumps of a yarn stuffed around the movable blade may be removed therefrom.

5. A device for finding an end of a yarn as claimed in claim 2, wherein said rotary cutter comprises:

a rotary member having an outer peripheral face, said rotary member being operable to rotate along said inner peripheral face of said suction case, and said rotary member having a plurality of yarn end sucking holes formed in said outer peripheral face thereof;

a tubular portion disposed on said rotary member; and a suction source in communication with said tubular portion.

6. A device for finding an end of a yarn as claimed in claim 5, wherein said rotary member has a groove formed therein for receiving said belt.

7. A device for finding an end of a yarn as claimed in claim 2, wherein said moving means comprises:

a frame wherein said rockable lever is supported for rocking movement on said frame and movable in a rocking motion, said rockable lever having a first end and a second end; and wherein said movable blade comprises a rockable blade disposed at said first end of said rockable lever and movable in a rocking motion.

8. A device for finding an end of a yarn as claimed in claim 7, wherein said moving means further comprises:

a shaft on which said rockable lever is mounted for rocking motion, and a cam follower disposed at said second end of said rockable lever;

wherein said drive means includes a grooved member, said grooved member having a cam groove adapted to guide said cam follower of said rockable lever.

9. A device for finding an end of a yarn as claimed in claim 7, wherein said movable lever has a substantially channel-shape recess formed at said second end thereof, said recess being shaped to receive said rockable blade inserted therein.

10. A device for finding an end of a yarn as claimed in claim 9, wherein said channel-shape recess has a blade receiving face formed therein, said blade receiving face having a pair of vertically inclined faces with central portions thereof projected in a direction toward the blade against the outer peripheral face of the rotary cutter, and wherein said lever includes a pin on which said blade is supported and pressed against said outer peripheral face of said rotary cutter.

11. A device for finding an end of a yarn as claimed in claim 10, further comprising a compression spring wound around said pin for urging said blade toward the central portion of said blade receiving face.

12. A yarn end finding device for finding a yarn end on a spinning bobbin comprising:

a rotary cutter having a rotatable member with a plurality of yarn end sucking holes operable to draw said yarn end, said rotatable member being rotatable in a first direction;

a cutting blade for cutting yarn drawn by said yarn end sucking holes of said rotatable member;

pivotable mounting means for mounting said cutting blade for pivotable and reciprocal movement in a direction substantially perpendicular to said first direction;

driving means for providing a rotational force for rotatably driving said rotatable member in the first direction; and cam means, operatively connected with the driving means, for converting a rotational force in the first direction to a reciprocating force in a second direction substantially perpendicular to the first direction;

wherein said cutting blade is operatively connected with said cam means and is pivotally and reciprocally driven about said pivotable mounting means by said reciprocating force in the second direction.

13. A yarn end finding and cutting device for finding and cutting yarn, said device comprising:

a movable member movable in a first direction;

a movable yarn cutting blade movable in a second direction substantially perpendicular to said first direction, said movable yarn cutting blade having a yarn cutting edge adapted to abut said movable member as said movable member moves in said first direction;

driving means, having a drive pulley, for driving said movable member in said first direction; and blade moving means, operatively connected with and driven by said drive pulley of said driving means, for moving said movable yarn cutting blade in said second direction.

14. A yarn end finding and cutting device as claimed in claim 13, wherein said movable member comprises a cylindrical member having an outer peripheral surface.

15. A yarn end finding and cutting device as claimed in claim 14, wherein said blade moving means comprising:

a rockable lever on which said movable yarn cutting blade is disposed;

a shaft on which said rockable lever is rockingly supported; and urging means for urging said yarn cutting edge against said outer peripheral surface of said cylindrical member.

16. A yarn end finding and cutting device as claimed in claim 13, wherein said driving means and said blade moving means are operatively connected to said movable member and said movable yarn cutting blade for simultaneously moving said movable member in said first direction and said movable yarn cutting blade in said second direction.

17. A yarn end finding and cutting device as claimed in claim 16, wherein said driving means comprises a rotary driver having a cam groove disposed therein; and said blade moving means comprises a lever on which said movable yarn cutting blade is disposed, and a cam follower disposed on said lever for engaging said cam groove of said rotary driver.

* * * * *